United States Patent [19]

Pardee

[11] Patent Number: 5,050,529

[45] Date of Patent: Sep. 24, 1991

[54] WALLPAPER PREPARATION APPARATUS

[76] Inventor: Chris Pardee, P.O. Box 917, Cameron Park, Calif. 95682

[21] Appl. No.: 573,882

[22] Filed: Aug. 27, 1990

[51] Int. Cl.[5] ..... B05C 3/12

[52] U.S. Cl. ..... 118/40; 118/419; 118/423

[58] Field of Search ..... 118/35, 39, 40, 41, 118/42, 43, 419, 428, 37, 423

[56] References Cited

U.S. PATENT DOCUMENTS

| | | | |
|---|---|---|---|
| 491,586 | 2/1893 | Peterson | 118/39 |
| 718,015 | 1/1903 | McCanless | 118/419 |
| 1,154,015 | 9/1915 | Headland | 118/39 |
| 1,327,127 | 1/1920 | Wanielista et al. | 118/39 |
| 2,247,447 | 7/1941 | Manka | 118/39 |
| 2,352,978 | 7/1944 | Shoemaker | 118/38 |
| 2,531,219 | 11/1950 | Johnston | 118/39 |
| 2,556,600 | 6/1951 | Renne | 118/39 |
| 2,614,521 | 10/1952 | Eida | 118/39 |
| 2,658,639 | 11/1953 | Goldberg | 156/575 |
| 2,745,376 | 5/1956 | Nowak | 118/48 |
| 2,758,738 | 8/1956 | Wynn | 118/38 |
| 2,843,083 | 7/1958 | Epling | 118/419 |
| 4,300,471 | 11/1981 | Desjardins | 118/235 |
| 4,711,682 | 12/1987 | Barbe et al. | 156/71 |
| 4,806,184 | 2/1989 | Shannon | 156/71 |

*Primary Examiner*—Willard Hoag

*Attorney, Agent, or Firm*—James M. Ritchey

[57] ABSTRACT

Presented is an easily portable, compartmentalized apparatus for aiding in the preparation of prepasted wallpaper for hanging on a surface. The apparatus has a wallpaper storage and delivery area, a wallpaper length measuring system, a wetting chamber, a cutting bar, and a sealable relaxation chamber for maintaining the wallpaper in a wetted state to permit relaxation of the wallpaper before hanging.

18 Claims, 2 Drawing Sheets

WALLPAPER PREPARATION APPARATUS

BACKGROUND OF THE INVENTION

1. Field of the Invention

The subject invention relates generally to an apparatus for preparing prepasted wallpaper for application to a surface, usually a wall. Disclosed is an easily portable, compartmentalized container having a wallpaper storage and delivery area, a measuring system, a wetting chamber, a cutting bar, and a vapor sealable relaxation chamber for the wetted wallpaper to relax and activate the adhesive while not drying.

2. Description of the Background Art

Various artifacts have been devised to assist a user is applying wallpaper to a wall. Most early devices related to wallpaper that needed to have a paste applied just prior to utilization on a wall. For user convenience prepasted wallpapers were developed. Such prepasted wallpapers require only a water wetting just before application to a desired surface. The prior references disclose several attempts at making the process of preparing prepasted wallpaper for hanging a more streamlined event. However, none of the prior apparatus combines all of the necessary elements for generating a ready to hang sheet of wetted prepasted wallpaper in one readily transportable unit.

U.S. Pat. No. 2,352,978 discloses a wallpaper machine for applying adhesive to a sheet of wallpaper. A perforated drum rotates through a chamber holding paste and brings a layer of the paste in contact with the wallpaper.

A trimming and pasting wallpaper machine is related in U.S. Pat. No. 2,556,600.

U.S. Pat. No. 2,658,639 shows a wallpaper hanger. The device has a wallpaper roll holder, a paste application roller, and a wallpaper applying roller.

Detailed in U.S. Pat. No. 2,745,376 is a method and machine for wallpaper hanging. Adhesive is applied to wallpaper within the device by at least one grooved roller. The wallpaper and grooved roller are held centrally within a trough and the paste applied as the paper is rolled out. A cutting guide is attached at the lip of the trough to aid in directly applying the pasted paper to a wall surface.

U.S. Pat. No. 2,758,738 discloses a wallpaper hanging apparatus with a means for applying an even layer of paste to the wallpaper. The apparatus accommodates a roll of wallpaper coupled by several rollers to a continuous mesh belt that delivers the paste to the wallpaper. The wallpaper feeds directly from the device to the wall surface.

Described in U.S. Pat. No. 4,300,471 is a wallpapering apparatus for either prepasted or nonpasted wallpaper. Several rollers guide the wallpaper through either water or paste that is contained in a trough. The paper flows directly from the device to the wall surface and then is cut to length.

Disclosed in U.S. Pat. No. 4,711,682 is a prepasted wallpaper application device and method of use. The device comprises an elongated cross-sectionally polygonal casing in which lies a web of wallpaper. The enclosed wallpaper is biased against two of the flat side walls of the casing by a weight rod engaged in the cylindrical hollow of the wallpaper web. The entire casing and enclosed wallpaper are submerged in water to activate the paste. After soaking, the casing is removed from the water and the wallpaper exits to a wall surface through a slot in one of the side walls.

U.S. Pat. No. 4,806,184 presents a hand-held wallpaper applicator that contains a length of wallpaper under tension for a smooth wall application. Wallpaper is cut to length, rolled into the device, soaked in water or paste, and applied to a wall surface by adjusting the device for the correct tension of the application rollers. A liquid level aids in positioning the wallpaper.

SUMMARY OF THE INVENTION

An object of the present invention is to provide an easily portable combined apparatus that permits a user both to wet prepasted wallpaper and to store that wetted wallpaper in a vapor loss resistant chamber until the wallpaper is relaxed and ready for hanging.

Another object of the present invention is to produce an apparatus for wetting and relaxing prepasted wallpaper that includes a measuring system that permits a user to determine the length of a wetted piece of wallpaper before hanging.

A further object of the present invention is to fabricate a wallpaper preparation apparatus that includes a timer for establishing the length of time the wetted wallpaper has relaxed.

A major hindrance to hanging prepasted wallpaper is that once the wallpaper is wetted by a wetting agent, the wetted wallpaper must sit for a period of time until it becomes relaxed and ready for hanging. Traditionally, this time period represented the hazard of the wetted wallpaper drying out and becoming unworkable. To eliminate this problem the subject apparatus includes a relaxation chamber that prevents the evaporation of most of the wetting agent during the length of time the wetted wallpaper must relax. This feature, being directly included into the structure of the subject apparatus, greatly enhances the handling characteristics of the relaxed wallpaper.

The subject apparatus comprises three distinct regions for preparing prepasted wallpaper: a wallpaper storage and delivery area; a wetting chamber; and a relaxation chamber. A series of rotatable wallpaper support members direct the delivered wallpaper from the wallpaper storage and delivery area through the wetting chamber and to a cutting bar that provides a straight edge for use with cutting the wallpaper into a sized sheet. Associated with the apparatus is a metering or measuring system that is linked to one of the rotatable wallpaper support members for establishing the length of the sized wallpaper sheet. The cut and wetted sheet of wallpaper resides in a vapor sealable relaxation chamber for a set period of time before hanging. To measure the set period of time a timer is associated with the subject apparatus.

Other objects, advantages, and novel features of the present invention will become apparent from the detailed description that follows, when considered in conjunction with the associated drawings.

DESCRIPTION OF THE PREFERRED EMBODIMENT

Figure 1:
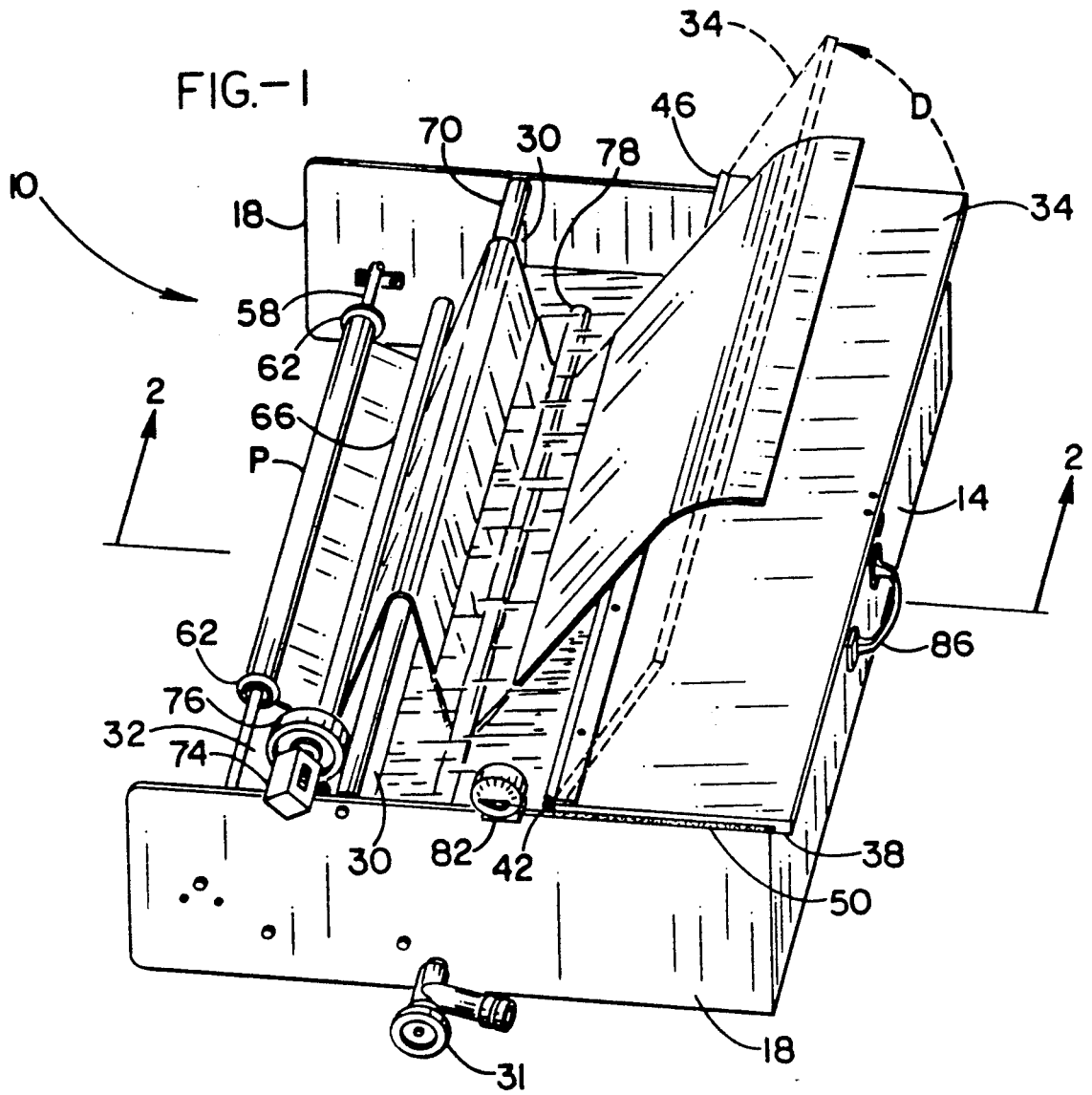
FIG. 1 is a perspective view of the subject apparatus with the relaxation chamber door closed and showing the position of a typical roll of wallpaper.
Figure 2:
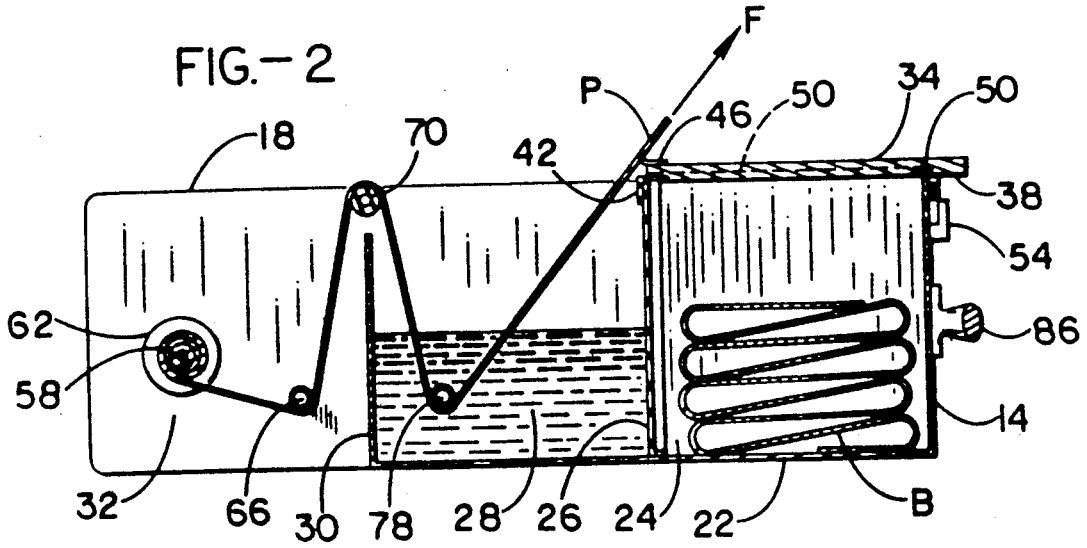
FIG. 2 is a cross sectional view of the subject apparatus taken along line 2—2 in FIG. 1.
Figure 3:
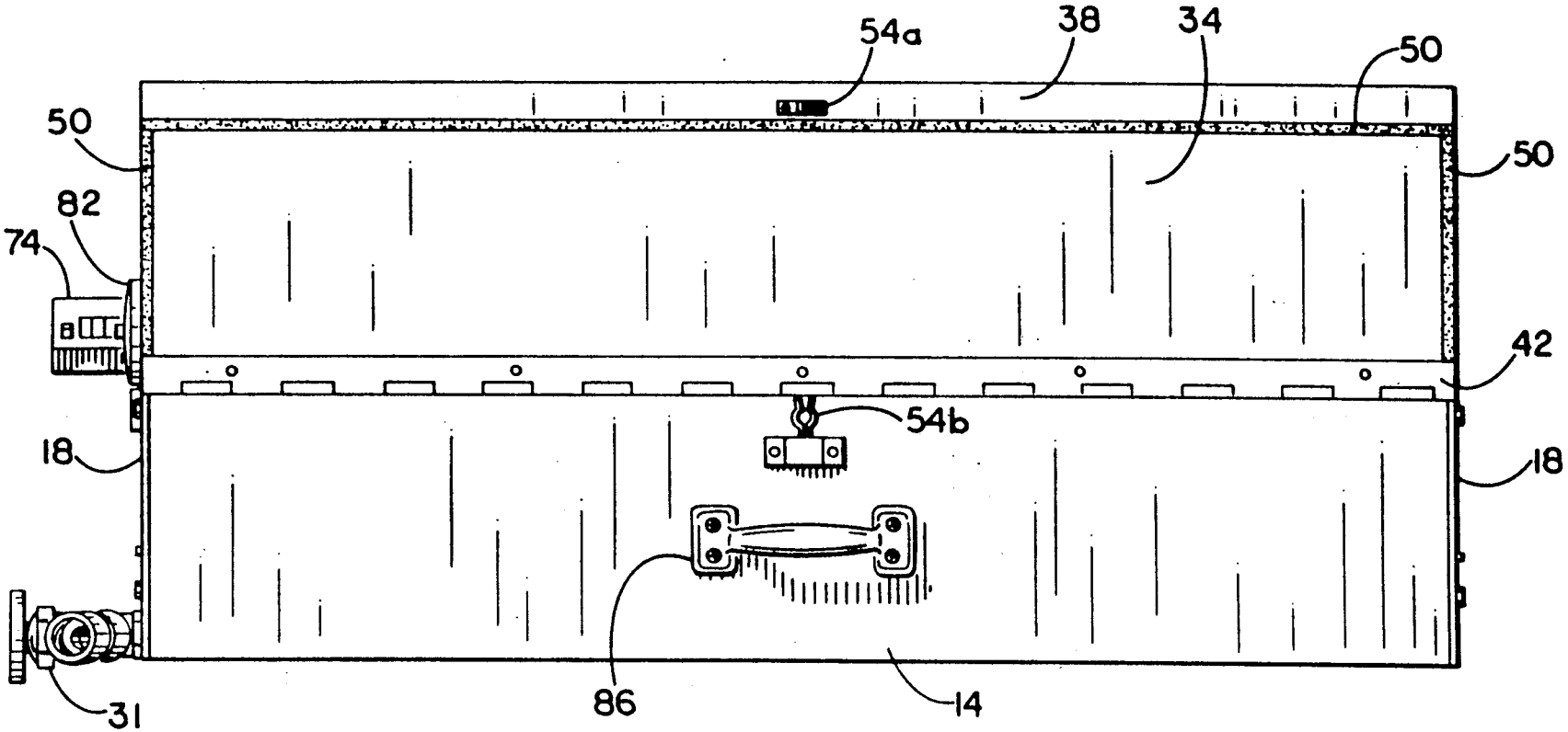
FIG. 3 is an end view of the subject apparatus showing the underside of the open relaxation chamber door.

Referring now to FIGS. 1-3, there is shown a preferred embodiment of a prepasted wallpaper P preparation apparatus or device 10. Within the various regions of the subject apparatus 10 are means for: holding or storing a roll of prepasted wallpaper P; wetting the wallpaper P with a wetting agent; assisting in cutting the wetted wallpaper P to a sized sheet; and means for maintaining a "booked" sized sheet of wetted wallpaper P in the wetted condition for a period of time until the wetted wallpaper P has "relaxed". The term "booked" refers to a folded sheet of wallpaper P and is illustrated in FIG. 2 via the letter B showing a layered sheet of wallpaper. The booked B sheet of wallpaper is folded in a manner to permit easy unfolding for hanging yet is compact enough to fit within a space of limited dimensions. The term "relaxed" implies that the adhesive or paste found on the prepasted wallpaper P has had time to fully absorb the wetting agent and activate to a suitable level of tackiness for hanging on a wall surface or other equivalent surface. Since the wetting agent may solubilize and remove the paste, the wetted wallpaper P should not stay in the wetting agent during relaxation, but be removed to a climate having sufficient wetting agent vapor to prevent drying. Further, the relaxation may include having the wallpaper P absorb the wetting agent, thereby becoming more pliable.

Although the wetting agent is usually water, a solution containing added material to enhance the binding characteristics of the paste, to improve the workability of the wallpaper P, to prevent growth of organisms on the wallpaper, to improve the appearance of the wallpaper, or to achieve similar goals is envisioned by this disclosure. Also, depending upon the chemical nature of the paste pre-applied to the wallpaper, a non-water based solvent may be appropriate The subject apparatus 10 comprises a number of wall or panel elements assembled into a central frame. Depending upon the material from which a panel element is constructed, each panel is secured to another panel by appropriate means such as welding, soldering, bending, gluing, melting, screwing, riveting, or like procedure, Usually, panels or wall elements are fabricated from essentially rigid materials such as sheet metal, fiber glass, wood, polymers, and the like.

One particularly useful configuration of the subject apparatus's central frame (see FIG. 1) comprises a generally U-shaped wall having two opposing sides and a front with each side and front having upper and lower edges, thereby enclosing three sides of the outer perimeter of the apparatus 10 and generating a U shape. Although a three sided U-shaped outer perimeter wall is preferred, the perimeter wall may be completely enclosed with four solid sides. More specifically, the U-shaped wall comprises a front panel 14 that has two ends and an upper and a lower edge secured at each end to side panels 18. Each side panel 18 has two ends and an upper and a lower edge. An alternative to having the U-shaped wall constructed from three separate panels that are secured together is to bend the U shape wall from one long panel.

A bottom panel 22 is secured to the lower edges of the U-shaped wall. Generally, the bottom panel extends from the front panel 14 attachment to short of the terminal portions of the U shaped wall. Creating a relaxation chamber 24 for holding wetted wallpaper P is a relaxation chamber panel 26 having two end edges and an upper edge and a lower edge. The relaxation chamber panel 26 spans between and is secured to the side panels 18 and is further secured to the bottom panel 22. The seams where the lower edges of panels (14, 18, and 22) are secured to produce the relaxation chamber 24 are wetting agent vapor and liquid tight. The upper edge of the relaxation chamber panel 26 is preferable proximate the upper edges of the side panels 18 (leaving sufficient space to accommodate a door hinge, discussed below).

Adjacent the relaxation chamber 24 is a wetting chamber 28. Disposed distally from the front panel 14 and past the relaxation chamber panel 26 is a wetting chamber panel 30 having two end edges and an upper edge and a lower edge. The wetting chamber panel 30 spans between and is secured to the side panels 18 and is further secured to the bottom panel 22 to generate the wetting chamber 28. The seams of the wetting chamber 28 are liquid tight to contain the wetting agent. Although the upper edge of the wetting chamber panel 30 is usually not flush with the upper edges of the side panels 18 (leaving sufficient space to locate a member employed to direct the movement of the wallpaper P through the apparatus, see the disclosure below), a flush orientation may be appropriate in equally acceptable embodiments of the subject apparatus.

Since a liquid wetting agent is contained within the wetting chamber 28, a valve 31 is fitted to a side panel 18 (see FIGS. 1 and 3), a wetting chamber panel 30, bottom panel 22, or like position, thereby projecting from the wetting chamber 28. If the wetting agent is water, the wetting chamber valve 31 may be connected via a hose to a water outlet for an immediately available supply of water. The hose connection allows a user to refill the wetting chamber 28 without leaving a working area, thereby speeding the process of hanging the wallpaper P on the selected surface in the work area. The valve 31 is attached to the wetting chamber 28 by standard means. Either a male or a female hose coupling may be secured to the valve 31 for mating with a suitable hose fitting.

Adjacent the wetting chamber 28 is a wallpaper storage and delivery area 32. Preferably (to decrease weight and to aid in mounting a roll of wallpaper P into the subject apparatus), the bottom panel 22 stops at and is secured to the wetting chamber panel 30, not extending beyond into the wallpaper storage and delivery area 32. The wallpaper storage and delivery area 32 holds a roll of prepasted wallpaper P until a user pulls the wallpaper P through the apparatus 10.

The various panels (14, 18, 22, 26, and 30) described above comprise the main body of the subject device 10. Further components are secured at the following specified locations to complete the structure of the subject apparatus 10. To prevent the escape of vapor from the wetting agent on a wetted sheet of wallpaper P, relaxation chamber door 34 is secured over the relaxation chamber 24. Usually, the door 34 has a hinge 42 that is affixed to the relaxation chamber panel 26 upper edge, but the hinge point may be at any suitable position such as via the front panel 14 or side panel 18. Since the hinge 42 is preferably affixed to the upper edge of the relaxation chamber panel 26, the relaxation chamber panel 26 upper edge is proximate each side panel 18 upper edge. As long as the door 34 retards the loss of wetting agent vapor, the relaxation chamber panel 26 upper edge may be flush with the side panel 18 upper edges if a particular hinge 42 is mounted above the side panel 26 upper edges or mounted in a different panel location.

To assist a user in opening or swinging up (see D in FIG. 1) the door 34 a door front edge 38 extends past the front panel 14. Clearly, other equivalent means exist to replace the door front edge 38 to aid a user in opening the door 34, including standard handles or knobs.

To assure a vapor seal is produced when the door 34 seats against the upper edges of the relaxation chamber 24, a sealing strip 50 is secured to the lower side of the door 34, thereby reversibly contacting and sealing over the relaxation chamber 24 upper edge. FIG. 3 clearly depicts the preferred location of the sealing strip 50. If the hinge 42 sufficiently blocks the passage of vapor, the sealing strip 50 may be on only the three lower door 34 sides to which the hinge 42 is not mounted (FIG. 3) or the sealing strip 50 may completely surround the four lower sides of the door 34 including the hinge 42 area. It is appreciated that in some equivalent embodiments of the subject apparatus 10 the door 34 need not be hinged at all and simply set over the relaxation chamber 24 to create a sufficient vapor seal. The sealing strip 50 is made from a pliable material such as silicone, rubber, and the like. Further aiding in the prevention of vapor loss is a latch 54 that holds the door 34 against the relaxation chamber 24 upper edges, thereby assisting the sealing strip 50 in blocking vapor flow. As seen in FIG. 3, the latch 54 is preferably a pressure fit type that is constructed of two parts; a first half 54*a* associated with the door 34 and a second half 54*b* associated with the front panel 14 that fit within each other. Other equivalent latch 54 variations are equally suitable.

Secured to the subject apparatus 10 is a cutting bar 46 that is employed by a user as an aid in cutting a sheet of wallpaper P after it is wetted. The cutting bar 46 may serve as a straight edge or hard surface on which to cut the wallpaper P or may include actual cutting edges for severing the wallpaper P. FIGS. 1 and 2 indicate that the cutting bar 46 is located on the upper surface of the door 34 proximate the hinge 42 attachment position or relaxation chamber panel 26 upper edge. This location is preferred, but other equivalent locations are contemplated to be within the realm of this disclosure. The cutting bar 46 is fabricated from a hard or material such as aluminum or other metal or nonmetal that resists cutting by a razor or other cutting device utilized by a user.

Means for holding or storing the wallpaper P within the wallpaper storage and delivery area 32 comprises a two ended wallpaper support member 58 that fits through the middle of a roll of wallpaper P and spans between the side walls 18. Preferably, the wallpaper support member 58 is an easily removable rigid rod (either solid or hollow) that fits loosely within the roll of wallpaper P and allows the wallpaper P to be pulled easily from the roll. Each of the two wallpaper support member 58 ends fits within a releasable receiving component associated with a side wall 18. The receiving component is preferably a pressure fitting clip that secures about each end of the wallpaper support member 58, but may be a depression or other holding device. To position the wallpaper P towards the middle of the wallpaper support member 58, two stops 62 are provided. Each stop 62 is located proximate one end of the wallpaper P roll. A pliable disk with a central opening for receiving and firmly grasping the wallpaper support member 58 or other equivalent device is suitable for the stop 62.

Means for directing the wallpaper P from the storage area 32 into the wetting chamber 28 is incorporated into the subject device 10. Preferably, the directing means, for directing the wallpaper P through the subject apparatus 10, comprises a plurality of rod shaped members rotatably anchored to and spanning between the side panels 18. Since the wallpaper P roll is loosely held by the wallpaper support member 58, a two ended rotatable storage and delivery area member 66 is provided to maintain added tension on the wallpaper P as a user pulls (along a direction indicated by the letter F) the wallpaper P from the roll. The member 66 is preferably a rigid rod (either solid or hollow) that has means for permitting rotation about the rod's longitudinal axis. Usually the rotation means comprises a simple bearing assembly or equivalent mechanism. Each end of the rotatable storage and delivery area member 66 is secured to a side panel 18 by means (usually a threaded portion projecting from the bearings that mates with locking nuts on either side of a side panel 18) that permits the rotation to occur but holds the member 66 firmly at the desired side panel 18 location, preferable proximate each side panels 18 lower edge between the wallpaper support member 58 and the wetting chamber panel 30.

A two ended rotatable wallpaper length measuring member 70 is positioned, preferably, above or proximate the wetting chamber panel 30, spanning between the side panels 18. To accommodate the rotatable measuring member's 70 preferred location, the wetting chamber panel 30 upper edge is displaced below the side panel's 18 upper edge (although other equivalent locations are contemplated). The measuring member 70 is similar in construction to the rotatable storage area member 66 and is secured to the side panels 18 in a like fashion. Coupled to the measuring member 70 is a wallpaper length meter 74 for determining the length of a sized sheet of wallpaper P that is to be booked B and held within the relaxation chamber 24. Although the meter 74 is preferably mounted proximate the storage and delivery area 32, other equivalent locations are suitable. The wheel 76 of the meter 74 presses against the surface of the measuring member 70 and turns as wallpaper P is pulled over the measuring member 70. Preferably, to prevent slippage at the contact region between the meter's wheel 76 and the measuring member's 70 surface, the measuring member's 70 surface is coated with a non-slip material such as rough rubber or like material. The rotational distance travel by the wheel 76 when the wallpaper P passes over the measuring member 70 is displayed as a visible number (that reflects the length of wallpaper P being measured) on the meter 74.

Once the wallpaper P passes over the measuring member 70 the wallpaper P is forced into the wetting chamber 28 and below the surface of the wetting agent by a two ended rotatable wetting chamber member 78, spanning between and anchored to the side panels 18, proximate the lower edges of the side panels 18 within the wetting chamber 28. The wetting chamber member 78 is similar in construction and side panel 18 attachment as the rotatable storage and delivery area member 66 and the measuring member 70.

To establish the time a wetted and booked sheet of sized wallpaper B has set within the sealed relaxation chamber 24, a means for timing is provided. The means for timing is usually a timer mounted or affixed to the apparatus 10 in a convenient location such as proximate a side panel 18 upper edge, as seen in FIG. 1.

To assist a user in transporting the subject apparatus 10, a handle 86 is usually secured at a convenient site. Attachment of the handle 86 to the front panel 14 is a preferred position.

A typical, although not limiting, method of utilizing the subject apparatus 10 comprises a user setting the apparatus 10 at an appropriate site near the surface to be covered. The wetting chamber 28 is filled by either using, preferably, the valve 31 to directly introduce the selected wetting agent or by just closing the valve 31 and pouring the wetting agent into the wetting chamber 28 from above. A selected roll of wallpaper P is fitted into the wallpaper storage and delivery area 32 by removing the wallpaper support member 58 and at least one associated stop 62, inserting one end of the support member 58 through the roll, refitting the stop or stops 62, and fitting the roll containing support member 58 back into the storage and delivery area 32. The wallpaper P is fed from around the support member 58 under the rotatable storage area member 66, over the rotatable measuring member 70, into the wetting chamber 28, under the rotatable wetting chamber member 78, out of the wetting chamber 28, and over the cutting bar 46. Usually, the user then zeroes the meter 74 and pulls a length of wallpaper P past the cutting bar until the desired length is achieved and the wallpaper P cut into a sized sheet. The wetted and sized sheet of wallpaper P is booked B and set in the relaxation chamber 24 for a period of time readable on the associated timer. Upon removal of the book B from the relaxation chamber 24, the wallpaper is unfolded and applied to the desired surface.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An apparatus for preparing prepasted wallpaper for hanging on a surface comprising:

a) means for holding a roll of said wallpaper;

b) means for wetting said wallpaper with a wetting agent;

c) means for assisting in the cutting of said wetted wallpaper to a sized sheet; and d) means for maintaining said size sheet of wallpaper in said wetted condition for a period of time to permit relaxation of said wallpaper before applying said wallpaper to said surface.

2. An apparatus according to claim 1, further comprising means for determining length of a cut strip.

3. An apparatus according to claim 1, further comprising means for determining said period of time.

4. An apparatus for preparing prepasted wallpaper for hanging on a surface comprising:

a) a wallpaper storage and delivery area for holding a roll of wallpaper and delivering said wallpaper upon demand by a user;

b) a wetting chamber secured to said storage area for containing a wetting agent to wet said delivered wallpaper;

c) a cutting bar secured proximate said wetting chamber for assisting in the cutting of said wetted wallpaper to a sized sheet; and d) a relaxation chamber secured to said wetting chamber for permitting said wetted wallpaper to relax for a period of time before hanging on said surface.

5. An apparatus according to claim 4, further comprising a wallpaper length meter for determining the length of said sized sheet of wallpaper wherein said meter is mounted proximate said storage and delivery area.

6. An apparatus according to claim 4, further comprising a timer mounted to said apparatus for determining said period of time.

7. An apparatus for preparing prepasted wallpaper for hanging on a surface comprising:

a) a generally U-shaped wall having two sides and a front, each said side and said front with upper and lower edges;

b) a relaxation chamber panel having upper and lower edges spanning between said sides of said U-shaped wall;

c) a wetting chamber panel having upper and lower edges spanning between said sides of said U-shaped wall;

d) a bottom panel secured to said U-shaped wall lower edges, said relaxation chamber panel lower edge, and said wetting chamber panel lower edge, thereby generating; a wallpaper storage and delivery area bounded by said wetting chamber panel and said sides for holding a roll of said wallpaper; a wetting chamber bounded by said relaxation chamber panel, said wetting chamber panel, said sides, and said bottom for holding a wetting agent for wetting said wallpaper; and a relaxation chamber bounded by said front, said relaxation chamber panel, said sides, and said bottom panel for holding said wetted wallpaper for a period of time to permit said wetted wallpaper to relax before said hanging;

e) a relaxation chamber door sealable against said relaxation chamber's upper edges wherein said sealed relaxation chamber retards the loss of said wetting agent from said wetted wallpaper within said relaxation chamber;

f) a cutting bar secured to said relaxation chamber door proximate said relaxation chamber panel upper edge for assisting in the cutting of said wallpaper into a sheet;

g) means for directing said wallpaper from said wallpaper storage and delivery area into said wetting chamber for wetting by said wetting agent; and h) means for determining said cut sheet's length.

8. An apparatus according to claim 7, further comprising means for determining said period of time.

9. An apparatus according to claim 8, wherein said timing means comprises a timer affixed proximate one of said side's upper edge.

10. An apparatus according to claim 7, wherein said directing means comprises a plurality of rotatable members spanning between said sides wherein when a user pulls said wallpaper from said wallpaper storage and delivery area said rotatable members force said wallpaper into said wetting agent.

11. An apparatus according to claim 10, wherein said length determining means comprises a wallpaper length meter wherein said meter is mounted proximate said storage and delivery area and coupled to said to one of said rotatable members wherein when said wallpaper is pulled by said user said meter determines the length of said wallpaper passing over said rotatable member.

12. An apparatus for preparing a prepasted sheet of wallpaper for hanging on a surface comprising:

a) a generally U-shaped wall comprising:

a front panel having first and second front panel end edges, an upper front panel edge, and a lower front panel edge; and first and second side panels with each said side panel having first and second side panel edges end edges, an upper side panel edge, and a lower side panel edge wherein said front panel first end edge is secured to said first side panel first end edge and said front panel second end edge is secured to said second side panel first end edge thereby producing said U-shaped wall;

b) a relaxation chamber panel having first and second relaxation chamber panel end edges, an upper relaxation chamber panel edge, and a lower relaxation chamber panel edge wherein said relaxation chamber panel is secured by said first relaxation chamber panel end edge to said first side panel and said second relaxation chamber panel end edge is secured to said second side panel with said lower relaxation chamber panel edge flush with said side panel lower edges and said upper relaxation chamber panel edge proximate said side panel upper edges;

c) a wetting chamber panel having first and second wetting chamber panel end edges, an upper wetting chamber panel edge, and a lower wetting chamber panel edge wherein said wetting chamber panel is secured to said side panels between said first and second side panel second end edges and where said relaxation chamber panel is secured to said first and second side panels by said first wetting chamber panel end edge to said first side panel and said second wetting chamber panel end edge to said second side panel wherein said lower wetting chamber panel edge is flush with said side panel lower edges and said upper wetting chamber edge is displaced toward said side panel lower edges from said side panel upper edges;

d) a bottom panel having first and second side bottom panel edges, a front bottom panel edge, and a rear bottom panel edge wherein said first side bottom panel edge is secured to said first side panel lower edge, said second side bottom panel edge is secured to said second side panel lower edge, said front bottom panel edge is secured to said front panel lower edge, said rear bottom panel edge is secured to said wetting chamber panel lower edge, and said relaxation chamber lower edge is secured to said lower bottom panel between said front panel and said wetting chamber panel thereby forming a wetting chamber above said bottom panel and between said wetting chamber panel and said relaxation chamber panel, a relaxation chamber above said bottom panel between said relaxation chamber panel and said front panel, and a wallpaper storage and delivery area between said wetting chamber panel and said first and second side panel second side panel ends;

e) a relaxation chamber door hinged to said relaxation chamber panel upper edge and sealable against said front panel upper edge and said first and second side panel upper edges thereby retarding the loss of said wetting agent from said relaxation chamber when said door is sealed by closing against said panel upper edges;

f) a wallpaper support member removeably secured between said first and second side panels within said wallpaper storage and delivery area for holding a roll of said prepasted wallpaper;

g) a wallpaper storage and delivery area member rotatably secured between said first and second side panels proximate said first and second side panel lower edges within said wallpaper storage and delivery area wherein said wallpaper storage and delivery area member is between said wetting chamber panel and said wallpaper support member;

h) a wallpaper length measuring member rotatably secured above said wetting chamber panel between said first and second side panels; and i) a wetting chamber member rotatably secured between said first and second side panels proximate said first and second side panel lower edges within said wetting chamber.

13. An apparatus according to claim 12, further comprising a cutting bar secured to said relaxation chamber door proximate said relaxation chamber panel upper edge for assisting in the cutting of said wallpaper to a sized sheet.

14. An apparatus according to claim 13, further comprising a wallpaper length meter for determining the length of said sized sheet of wallpaper wherein said meter is mounted proximate said storage and delivery area and coupled to said wallpaper length measuring member wherein when wallpaper is pulled over said measuring member said meter determines the length of said wallpaper passing over said measuring member.

15. An apparatus according to claim 13, further comprising a timer mounted to said apparatus for determining a period of time said wallpaper stays in said relaxation chamber.

16. An apparatus according to claim 12, wherein said door seal is produced by a pliable strip of sealing material anchored to said door for reversibly contacting and sealing over said panel upper edges when said door is closed.

17. An apparatus according to claim 16, further comprising a wetting chamber valve projecting from said wetting chamber wherein said valve is for use in filling said wetting chamber with said wetting agent via a hose coupled between said valve and a source of said wetting agent.

18. An apparatus according to claim 12, further comprising a wetting chamber valve projecting from said wetting chamber wherein said valve is for use in filling said wetting chamber with said wetting agent via a hose coupled between said valve and a source of said wetting agent.

* * * * *